US008171703B2

(12) United States Patent
Arlinghaus et al.

(10) Patent No.: US 8,171,703 B2
(45) Date of Patent: May 8, 2012

(54) METHOD FOR PACKAGING PRODUCTS BY EMPLOYING POSITIVE PRESSURE DIFFERENTIAL

(75) Inventors: Mark E. Arlinghaus, Minneapolis, MN (US); David Jordan, Ramsey, MN (US); David A. Kirk, Coon Rapids, MN (US)

(73) Assignee: General Mills Marketing, Inc., Minneapolis, MN (US)

( * ) Notice: Subject to any disclaimer, the term of this patent is extended or adjusted under 35 U.S.C. 154(b) by 416 days.

(21) Appl. No.: 12/481,071

(22) Filed: Jun. 9, 2009

(65) Prior Publication Data

US 2010/0310742 A1 Dec. 9, 2010

(51) Int. Cl.
*B65B 55/00* (2006.01)

(52) U.S. Cl. ..... 53/436; 53/452; 53/405

(58) Field of Classification Search ..... 53/405, 53/436, 443, 450, 452, 456, 467, 476, 531, 53/559, 561, 523, 528, 527, 389.2, 389.3
See application file for complete search history.

(56) References Cited

U.S. PATENT DOCUMENTS

| | | | | |
|---|---|---|---|---|
| 3,216,832 | A | 11/1965 | King | |
| 3,956,867 | A * | 5/1976 | Utz et al. | 53/433 |
| 4,372,098 | A * | 2/1983 | Mason | 53/412 |
| 4,424,659 | A * | 1/1984 | Perigo et al. | 53/425 |
| 4,513,015 | A * | 4/1985 | Clough | 426/396 |
| 4,684,025 | A * | 8/1987 | Copland et al. | 206/484 |
| 4,769,245 | A | 9/1988 | Farrar et al. | |
| 5,323,590 | A * | 6/1994 | Garwood | 53/433 |
| 5,366,744 | A | 11/1994 | Drummond et al. | |
| 5,896,994 | A | 4/1999 | Krebs | |
| 6,868,654 | B2 * | 3/2005 | Douglas | 53/511 |
| 7,231,752 | B2 * | 6/2007 | Merken-Schiller et al. | 53/450 |
| 7,247,330 | B2 | 7/2007 | Kuethe et al. | |
| 2003/0014945 | A1 * | 1/2003 | Danby | 53/452 |
| 2004/0016205 | A1 * | 1/2004 | Douglas | 53/133.4 |
| 2004/0241283 | A1 | 12/2004 | Domingues et al. | |
| 2004/0241292 | A1 | 12/2004 | Geng et al. | |
| 2005/0025394 | A1 | 2/2005 | Kinigakis et al. | |
| 2005/0281923 | A1 | 12/2005 | Kubat et al. | |
| 2006/0263494 | A1 | 11/2006 | Geng et al. | |
| 2008/0152772 | A1 | 6/2008 | Bernig et al. | |
| 2008/0193612 | A1 | 8/2008 | Domingues et al. | |
| 2008/0209864 | A1 | 9/2008 | Fergusson et al. | |

FOREIGN PATENT DOCUMENTS

CA 2659764 A1 3/2008

* cited by examiner

*Primary Examiner* — Hemant M Desai
(74) *Attorney, Agent, or Firm* — Everett G. Diederiks, Jr.; Arlene L. Hornilla

(57) ABSTRACT

A method for packaging products, such as any solid or semi-solid product, utilizes a horizontal form, fill and seal (HFFS) system, coupled with a method for subjecting the packages to positive pressure differential while packaging. In the HFFS system, product receiving cavities are formed in a lower film, with each product being arranged in a respective cavity. The loaded product receiving cavities are positioned in a sealing unit, with an upper film above the product cavities. The sealing unit is closed and a lower chamber of the sealing unit is pressurized to force the lower film against the product, while the product abuts a standoff member, in order to remove existing headspace. After minimizing the headspace, a sealing head seals the upper film to the lower film about the product receiving cavities. Thereafter, the pressure is released, the sealing unit is opened and the package can be further processed.

12 Claims, 5 Drawing Sheets

METHOD FOR PACKAGING PRODUCTS BY EMPLOYING POSITIVE PRESSURE DIFFERENTIAL

FIELD OF THE INVENTION

The invention pertains to the art of packaging and, more particularly, to packaging solid and semi-solid products between upper and lower plastic films in a horizontal form, fill and seal (HFFS) system utilizing a positive pressure differential to minimize headspace.

BACKGROUND OF THE INVENTION

Certainly, there exists various known packaging systems employed to package a wide range of products. Cardboard containers are commonly employed, mainly due to their overall structure which protects stored products from damage. By way of example, it is known to store a refrigerated dough product in a canister of a fixed volume formed from composite paperboard which is spirally wound into a cylinder so the refrigerated dough product proofs while in the canister. However, packaging products in cardboard is actually, relatively expensive and, at least in connection with products having a small profit margin, can be cost prohibitive.

Although other types of packaging exist, at least a majority of these types of packages are simply not suited for certain products, such as refrigerated dough-based food products which require the control of headspace volume and composition.

Mainly because of cost efficiencies and packaging versatility, vertical and horizontal form, fill and seal packaging systems have become increasingly popular, particularly in the food industry. While vertical form, fill and seal systems have mainly been limited in connection with making sealed bags, such as potato chip and other types of snack bags, horizontal form, fill and seal packaging systems are considered to be much more versatile. By way of example, it is known to employ a horizontal form, fill and seal (HFFS) system to form product cavities or pouches in a lower film, fill the pouches with frozen dough products and seal the products in the pouches with an upper film. Prior to fully sealing the pouches, a vacuum is typically drawn in order to reduce the available headspace of the package. Although evacuating the headspace is appropriate for frozen dough products, employing a vacuum on a refrigerated dough product would destroy nucleation sites for leavener in the dough and, consequently, the overall product. However, if no vacuum is drawn, the headspace will fill with carbon dioxide which will chemically react with deplete the dough of leavening gas and swell the package.

Although the above discussion exemplifies disadvantages with utilizing an HFFS system with refrigerated dough products, numerous other products can be similarly affected. Certainly, the many advantages of utilizing HFFS systems make them enticing to employ. However, these advantages have mostly been outweighed by their disadvantages, at least with respect to particular products. To this end, there is seen to still exist a need for new ways of packaging various types of products, including refrigerated dough products, that can take advantage of the benefits of HFFS systems while avoiding known system drawbacks.

SUMMARY OF THE INVENTION

The invention is directed to a method for packaging products, such as any solid or semi-solid product, utilizing a horizontal form, fill and seal (HFFS) system wherein packaged products are subjected to a pressure differential, without applying a vacuum, prior to sealing. According to the invention, the packaging method includes creating product receiving cavities in a lower film, loading product in the product receiving cavities and introducing the loaded product receiving cavities into a sealing unit of the horizontal form, fill and seal assembly with an upper film above the loaded product receiving cavities within the sealing unit. Thereafter, the sealing unit is closed about the loaded product receiving cavities and a lower sealing chamber of the sealing unit is pressurized to minimize a headspace between the product and the upper film. This stage includes forcing the product against standoffs positioned in the sealing unit while maintaining a gap between the upper and lower films to allow the gas in the headspace to escape into an upper, vented cavity. After removing the headspace, a sealing head is activated to seal the upper film to the lower film about the loaded product receiving cavities. After releasing pressure in the lower sealing chamber, the sealing unit is opened in order to allow the packaged product to be conveyed to another system station, such as a cutting station.

With the above method, the problems associated with vacuum-based HFFS packaging systems are avoided and the range of products which can be packaged in accordance with the invention significantly increases. The invention is particularly adapted for use in packaging, refrigerated dough products as these products would actually be destroyed if a vacuum-based system were employed. When a relatively soft material, such as a refrigerated dough, is packaged with the system, the use of a positive pressure, without vacuum, advantageously enables the product to deform so as to take-up some headspace, a result which would be not be possible with a vacuum-based system.

Additional objects, features and advantages of the invention will become more readily apparent from the following detailed description when taken in conjunction with the drawings wherein like reference numerals refer to corresponding parts in the several views.

DETAILED DESCRIPTION OF EMBODIMENTS

Figure 1:
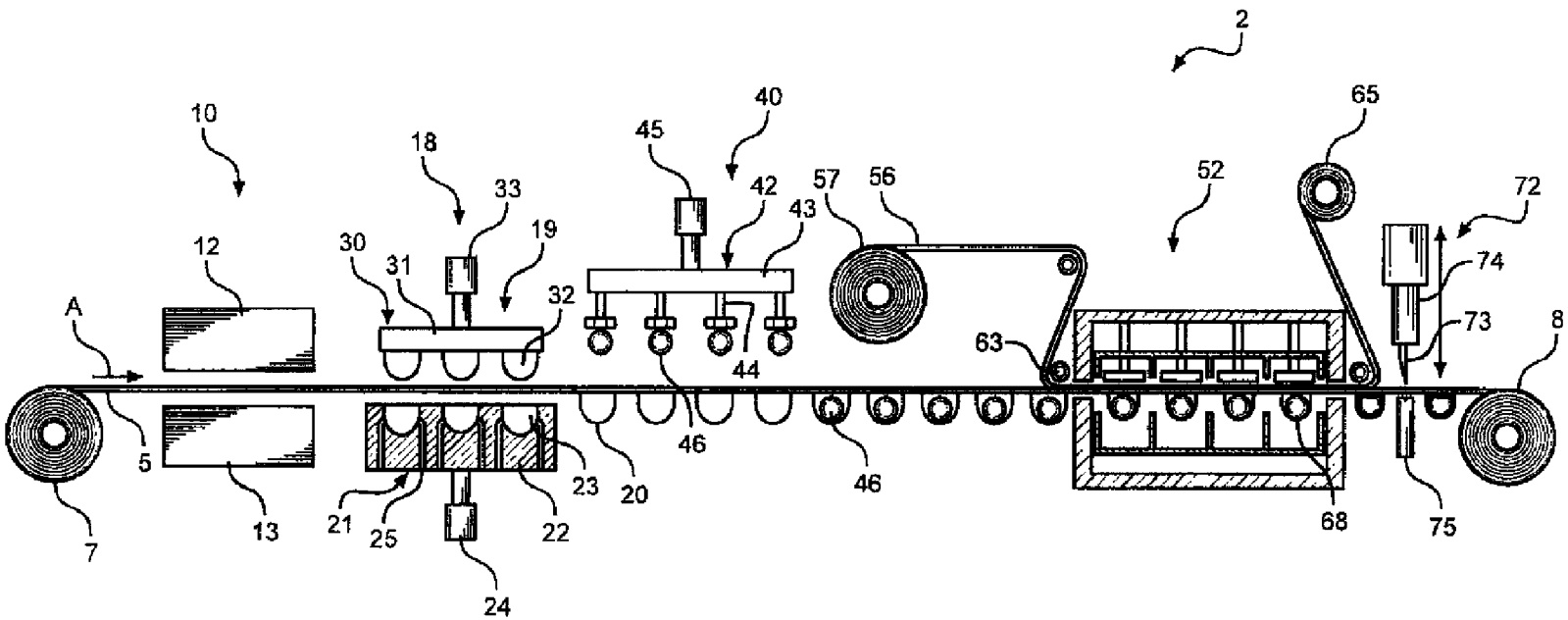
FIG. 1 schematically illustrates a horizontal form, fill and seal (HFFS) system which functions in accordance with the method of the invention.

With initial reference to FIG. 1, a horizontal form, fill and seal (HFFS) system employed in connection with the packaging method of the present invention is generally indicated at 2. As shown, system 2 has associated therewith a first or lower film 5 which runs from a payout reel 7 in the direction of arrow A to a take-up reel 8. As will become more fully evident below, the majority of film 5 is used in connection with packaging products in accordance with the invention and take-up reel 8 receives the left over or scrap film. In a preferred form of the invention, take-up reel 8 merely receives lateral edge portions of lower film 5, such as an inch (approximately 2.54 cm) of either side of film 5 while the remainder of the film 5 is employed in the final package. In any case, lower film 5 is first directed to a heating station 10 and is directed between upper and lower heating units 12 and 13. In general, heating station 10 can employ various types of heater units 12, 13 known in the art, such as radiant and/or convection heaters. Basically, it is simply desired to heat lower film 5 for delivery to forming station 18. In forming station 18, a thermoforming unit 19 is employed to produce product cavities 20 in lower film 5. To this end, thermoforming unit 19 includes a lower cavity mold 21 having a main body 22 formed with recessed cavities 23. A linear actuator 24 is connected to main body 22 and designed to vertically shift main body 22 during the forming of product cavities 20. For use in connection with the forming process, fluid communication lines, such as that indicated at 25, extend through main body 22 to recessed cavities 23. In conjunction with lower cavity mold 21, thermoforming unit 19 includes an upper cavity mold 30 which also includes a main body 31 from which extend various projection molds 32 that conform to recessed cavities 23. In a manner similar to lower cavity mold 21, upper cavity mold 30 is connected to a linear actuator 33 used to vertically shift upper cavity mold 30 during a thermoforming operation.

In general, thermoforming devices such as that employed in connection with forming station 18 are widely known in the art and do not form part of the present invention. However, for the sake of completeness, it should at least be understood that the function of forming station 18 is to receive heated lower film 5 between lower cavity mold 21 and upper cavity mold 30 at which time the movement of lower film 5 is temporarily stopped, projection molds 32 are mated with recessed cavities 23 in order to reshape lower film 5 to include product cavities 20. To aid in this shaping operation, fluid communication lines 25 can be hooked to a vacuum source in order to draw lower film 5 against recessed cavities 23 as well as to subsequently apply a positive pressure to aid in removing the formed product cavities 20 from lower cavity mold 21 after the thermoforming process is complete.

Once product cavities 20 are formed in lower film 5, lower film 5 advances to a loading or filling station generally indicated at 40. At this point, it should be recognized that filling station 40 can take various forms without departing from the invention. As illustrated, filling station 40 includes a vertical loading unit 42 including a platform 43 from which extend various loading arms 44 used to transport products, such as that indicated at 46, into the individual product cavities 20.

After products 46 are loaded into product cavities 20, lower film 5 is advanced to a sealing station 52. The present invention is particularly concerned with the manner in which products 46 are sealed within product cavities 20 such that details of sealing station 52 will be more fully described below. However, as is widely known in connection with standard HFFS systems, a second or upper film 56 is drawn from a payout reel 57. After following various guide rollers 63 to sealing station 52, the remainder of upper film 56 is directed to a take-up reel 65. At sealing station 52, upper film 56 is sealed to lower film 5 across product cavities 20 in order to create an overall product package indicated at 68. Thereafter, package 68 is directed to a cutter station 72 wherein a blade element 73 is shifted vertically through the use of a linear actuator 74 against an anvil member 75 in order to cut each package 68 from the overall web defined by the mated lower film 5 and upper film 56.

Figure 2:
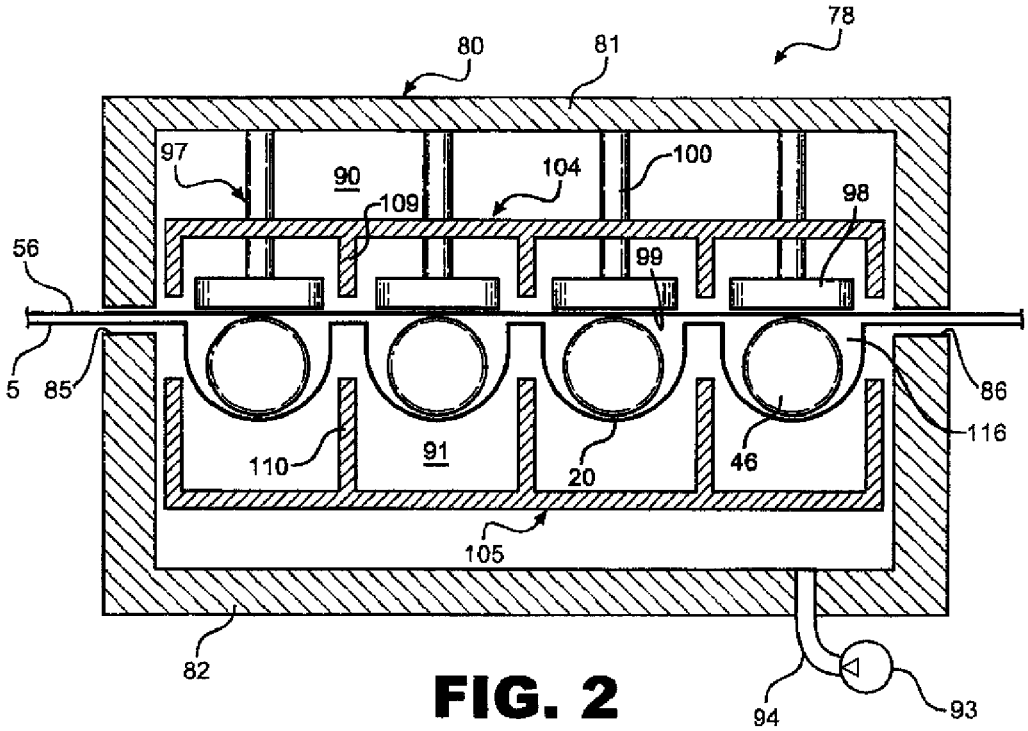
FIG. 2 is a cross-sectional view of the sealing unit incorporated in the HFFS system of FIG. 1, with the sealing chamber being in a partially open condition.

Reference will be now made to FIG. 2 in detailing an embodiment of sealing station 52 in accordance with the invention. As shown, sealing station 52 employs a sealing unit 78 defined by a housing 80 including an upper housing portion 81 and a lower housing portion 82. Housing 80 has associated therewith an inlet opening 85 and an exit opening 86, each of which is only shown to be partially open in this figure. Basically, upper and lower housing portions 81 and 82 are adapted to be vertically shifted relative to each other by linear actuators (not shown) in order to vary the size of inlet and exit openings 85 and 86 in order to enable housing 80 to receive or discharge both lower film 5 with products 46 in product cavities 20 and upper film 56 as illustrated. Above upper film 56 within housing 80 is defined a vented, upper cavity 90. Upper cavity 90 can be vented in various ways, such as with one or more vent ports (not shown) or forming upper housing portion 81 as an open framework. Below lower film 5 within housing 80 is defined a lower sealing chamber 91. At least lower sealing chamber 91 in accordance with the invention is connected to a compressed fluid supply unit 93, such as an air compressor, through a line 94.

Also arranged within housing 80 is a plurality of spaced standoffs 97. In the embodiment shown, standoffs 97 are fixed relative to upper housing portion 81 and include plate members 98, having substantially flat lower surfaces 99, suspended within upper housing portion 81 through respective rods 100. As clearly evident from viewing this figure, the number of standoffs 97 is commensurate with the number of product cavities 20 which are accommodated within sealing unit 78 for a given sealing cycle of HFFS system 2. Also arranged within housing 80 is an upper sealing element 104 and a lower sealing element 105. Upper and lower sealing elements 104 and 105 are vertically shiftable within upper and lower housing portions 81 and 82 respectively. However, for sake of clarity of the drawings, the linear actuators employed in connection with shifting upper and lower sealing elements 104 and 105 have not been depicted. In any case, upper and lower sealing elements 104 and 105 include various spaced, mating sealing arms, such as that indicated at 109 and 110. As clearly evident, each set of sealing arms 109, 110 are positioned along a respective portion of each package 68. Although not clearly shown in this figure due to the cross-section depicted, mating sealing arms 109 and 110 would extend around the entire periphery of each respective product cavity 20 and, as will be described further below, are used in sealing upper film 56 to lower film 5 and, consequently, a given product 46 in a respective cavity 20.

Figure 3:
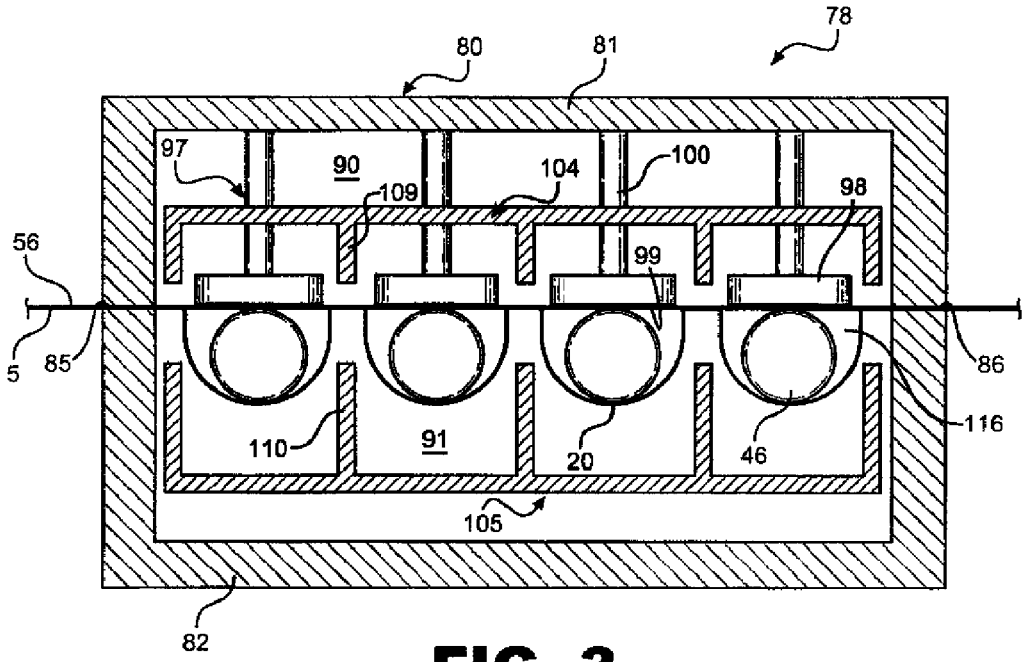
FIG. 3 is a cross-sectional view of the sealing unit of FIG. 2 in a closed state.
Figure 4:
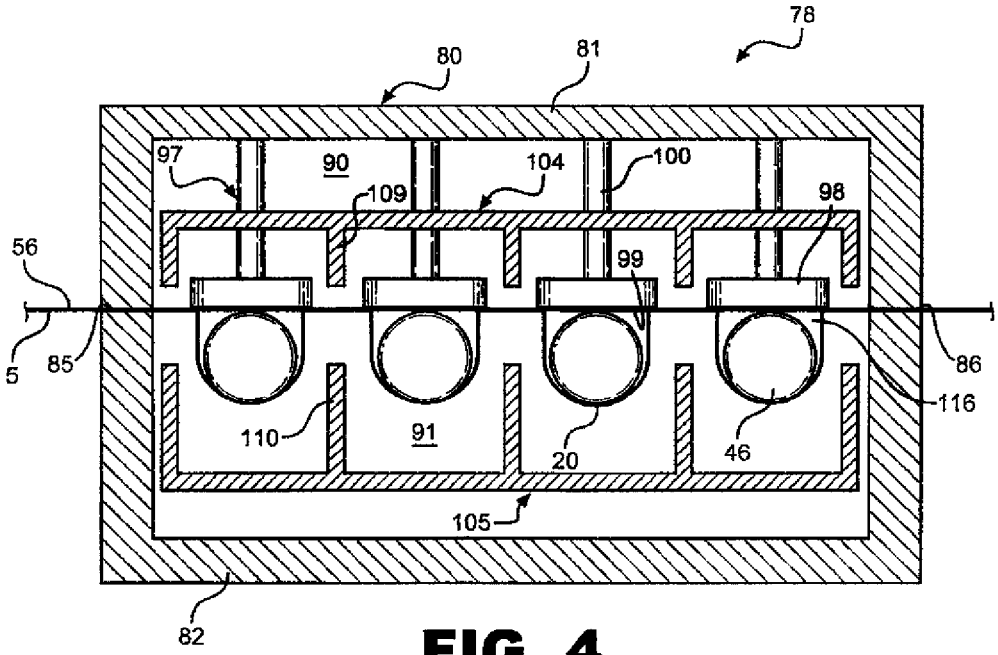
FIG. 4 is a cross-sectional view of the sealing unit following pressurizing of a lower chamber of the sealing unit.
Figure 5:
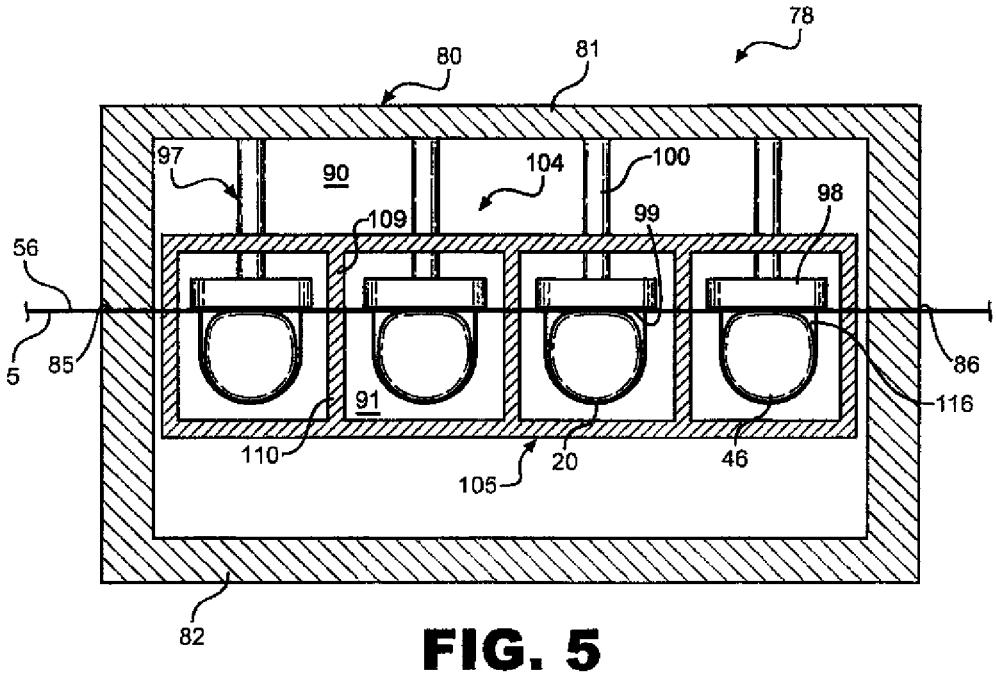
FIG. 5 is a cross-sectional view of the sealing unit with heat seals being activated.

Reference will now be made to FIGS. 2-7 in describing the operation of sealing unit 78 in connection with the present invention. As indicated above, FIG. 2 depicts sealing unit 78 with inlet and exit openings 85 and 86 exposed. Correspondingly, housing 80 is partially open in FIG. 2. In FIG. 3, upper and lower housing portions 81 and 82 have been brought together such that inlet and exit openings 85 and 86 are fully closed, along with lower sealing chamber 91. At this time, it should be at least noted that upper and lower sealing elements 104 and 105 are spaced from both upper film 56 and lower film 5. Thereafter, the sealing operation proceeds to FIG. 4 wherein compressed fluid supply unit 93 is activated to pressurize lower sealing chamber 91. At this time, lower film 5 is forced upward within housing 81 which actually causes both upper film 56 and product 46 to be forced against a respective standoff 97. This action is perhaps best depicted from seeing the manner in which product 46 converts from the rounded upper configuration shown in FIG. 3 to a flat upper configuration in FIG. 4, while lower film 5 defining product cavity 24 is drawn about product 46. At this point, it should be recognized that this deformation occurred in connection with the packaging of soft dough and relatively high pressure in sealing unit 78. Therefore, dough deformation need not occur, such as when packing flat biscuits in a pouch. In any case, at the same time, the head space 116 (see FIG. 3) within each product cavity 20 is minimized. Although both product 46 and upper film 56 are forced against a standoff 97, the gas within headspace 116 is forced to flow between lower film 5 and upper film 56. This gas flow can be enhanced in various ways, such as by pre-forming upper film 56 with various slits in the regions between product cavities 20 or by making upper film 56 narrower than upper cavity 90 such that the gas from headspace 116 will be free to flow into upper cavity 90. As upper cavity 90 is vented, the gas is readily released. As the pressure within lower sealing chamber 91 is increased, lower film 5 is further forced against product 46 and the air in headspace 116 in between films 5 and 56 is expelled.

Figure 6:
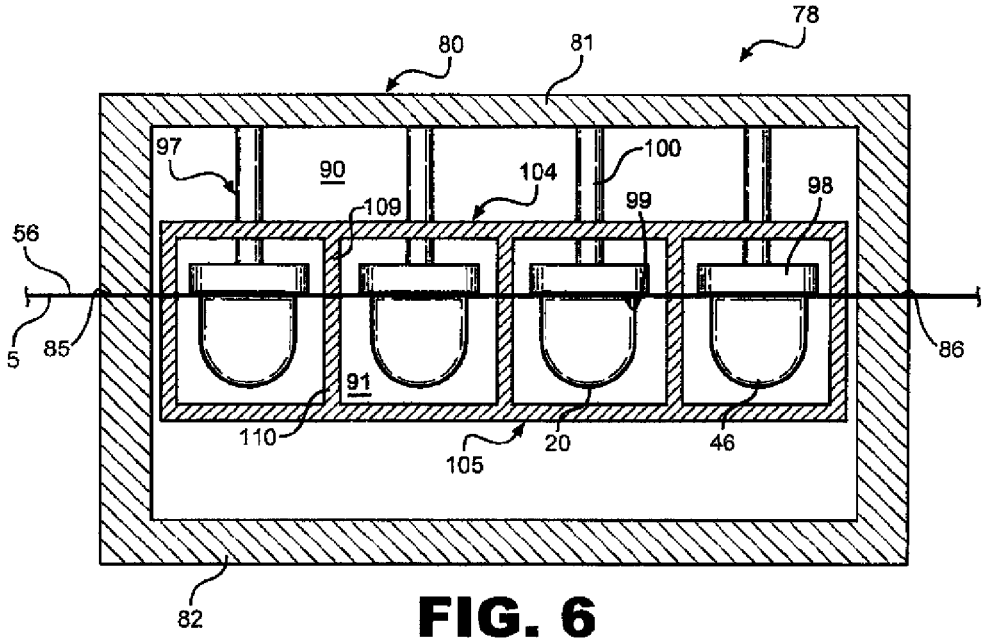
FIG. 6 is a cross-sectional view of the sealing unit with the lower chamber pressure being released.
Figure 7:
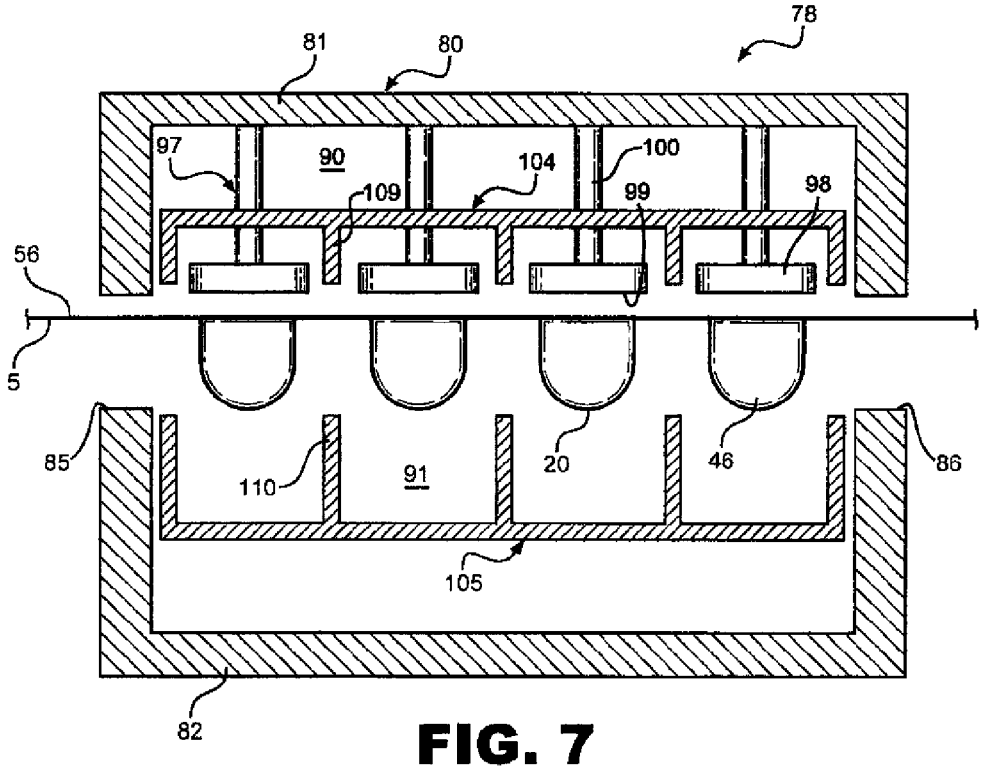
FIG. 7 is a cross-sectional view of the sealing unit in a fully open condition.

In one form of the invention wherein product 46 constitutes a refrigerated dough product, lower sealing chamber 91 is preferably pressurized between 0.5 and 50 psi, more preferably, in the order of 25 psi for a large package and 2 psi for a small package. When a soft material is being packaged, such as a refrigerated dough, product 46 can actually deform as discussed above to take up some of the headspace 116. At this point, it should be clearly noted that the pressure differential arrangement employed in connection with sealing unit 78 is done without a vacuum. In any case, after headspace 116 is minimized, the sealing operation proceeds to that shown in FIG. 5 wherein upper and lower sealing elements 104 and 105 are brought together about product cavities 20 to seal lower and upper films 5 and 56. Thereafter, the pressure within lower chamber 91 is released as shown in FIG. 6. At this point, products 46 are sealed inside the low volume product cavities 20, upper and lower housing portions 81 and 82 are shifted relative to each other to expose inlet and outlet openings 85 and 86 as shown in FIG. 7, then the packaging operation proceeds to cutter station 72. In accordance with a variant of the invention, package 68 can be further wrapped in a film (not shown) which is shrunk about the package 68, such as by heating, thereby developing an applied force which is essentially transferred to static pressure within package 68.

Figure 8:
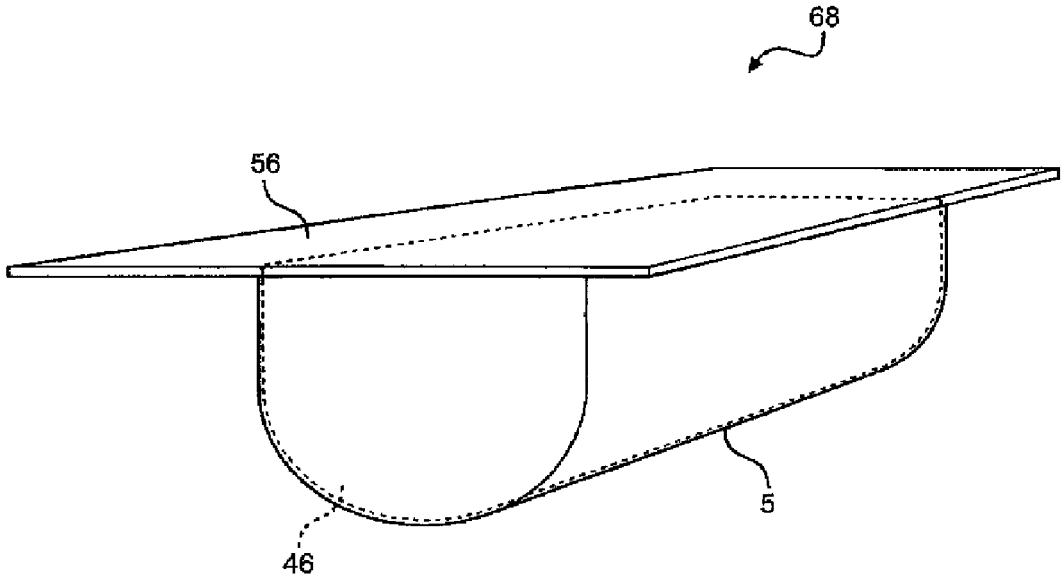
FIG. 8 is a perspective view of a dough product packaged in accordance with the invention.

FIG. 8 is a perspective view of package 68 following cutter station 72. In the embodiment shown, the soft, low temperature dough product has generally taken a D-shape with a flat top due to the application of the pressure in connection with sealing unit 78. Because of the use of the pressure method of the invention, the invention is only applicable for use in packaging relatively rigid objects, i.e., any solid or semi-solid object. That is, the invention can be employed in connection with any solid or rigid product, semi-solid product such as jello, but not liquids. However, it should be recognized that the invention could be employed in connection with the combination of a liquid with a solid so long as the liquid had a high enough viscosity and associated properties to prevent it from being squirted out between the upper and lower films during the pressurization phase. Therefore, in connection with at least the food art, other exemplary products can include jello, vegetables, overall meals and frozen products, while the use of the invention with rigid products can take various forms including medical products, toys, electronics and the like. Still, given the unique problems associated with refrigerated dough products, the fact that the present sealing arrangement of the present invention does not employ a vacuum provides significant advantages over a HFFS system which would either employ a vacuum or even a combination of a vacuum and positive pressure. In any case, although described with reference to embodiments of the invention, it should be readily understood that various changes and/or modifications can be made to the invention without departing from the spirit thereof. Instead, the invention is only intended to be limited by the scope of the following claims.

We claim:

1. A method of packaging products with a horizontal form, fill and seal assembly comprising:

creating product receiving cavities in a lower film;

loading product in the product receiving cavities; and sealing the product in the product receiving cavities by:

a) introducing the loaded product receiving cavities into a sealing unit of the horizontal form, fill and seal assembly;

b) positioning an upper film above the loaded product receiving cavities within the sealing unit;

c) closing the sealing unit about the loaded product receiving cavities;

d) pressurizing a lower sealing chamber of the sealing unit to evacuate a headspace between the product and the upper film;

e) after evacuating the headspace, activating a sealing head to seal the upper film to the lower film about the loaded product receiving cavities, wherein the product is sealed in the product receiving cavities in the absence of any vacuum being drawn in the sealing unit;

f) releasing pressure in the lower sealing chamber; and e) opening the sealing unit.

2. The method of claim 1, wherein air from the headspace is forced out between the upper and lower films upon pressurizing of the lower sealing chamber.

3. The method of claim 2, wherein the air flows from the headspace into a vented, upper cavity of the sealing unit arranged above the upper film.

4. The method of claim 2, wherein the lower film is forced against the product by pressurizing of the lower sealing chamber.

5. The method of claim 1, wherein each product is forced against a standoff member when the lower sealing chamber is pressurized.

6. The method of claim 5, wherein the product deforms against the standoff member when the lower sealing chamber is pressurized.

7. The method of claim 6, wherein the lower film conforms to the shape of the product as deformed.

8. The method of claim 6, wherein the product constitutes a refrigerated dough.

9. The method of claim 8, wherein the refrigerated dough is flattened against each of the standoff and the upper film.

10. The method of claim 1, wherein the product is not subjected to pressures below 900 mbar absolute throughout the sealing process.

11. The method of claim 1, wherein the product receiving cavities are thermoformed in the lower film.

12. The method of claim 1, wherein a positive differential pressure is maintained between the lower sealing chamber and the upper cavity following pressurization of the lower sealing chamber and until the pressure is released.

* * * * *